US011399241B2

(12) United States Patent
Troelsen

(10) Patent No.: US 11,399,241 B2
(45) Date of Patent: Jul. 26, 2022

(54) DEVICE WITH DECOUPLING ELEMENT CONFIGURED BETWEEN RESPECTIVE GROUND PLANES FOR ANTENNA AND COIL

(71) Applicant: Oticon A/S, Smørum (DK)

(72) Inventor: Jens Troelsen, Smørum (DK)

(73) Assignee: Oticon A/S, Smørum (DK)

( * ) Notice: Subject to any disclaimer, the term of this patent is extended or adjusted under 35 U.S.C. 154(b) by 0 days.

(21) Appl. No.: 17/100,567

(22) Filed: Nov. 20, 2020

(65) Prior Publication Data

US 2021/0160630 A1 May 27, 2021

(30) Foreign Application Priority Data

Nov. 21, 2019 (EP) ..... 19210687

(51) Int. Cl.

| | |
|---|---|
| ***H04R 25/00*** | (2006.01) |
| ***H01Q 1/27*** | (2006.01) |
| ***H01Q 1/28*** | (2006.01) |
| ***H01Q 1/48*** | (2006.01) |

(52) U.S. Cl.
CPC ..... *H04R 25/554* (2013.01); *H01Q 1/273* (2013.01); *H01Q 1/48* (2013.01); *H04R 2225/51* (2013.01)

(58) Field of Classification Search
CPC ..... H01Q 1/27; H01Q 1/273; H01Q 1/48; H01Q 1/52; H01Q 7/06; H01Q 21/28; H04R 9/04; H04R 25/00; H04R 25/554; H04R 2225/00; H04R 2225/49; H04R 2225/51
USPC ..... 381/312, 315, 331
See application file for complete search history.

(56) References Cited

U.S. PATENT DOCUMENTS

| | | | | |
|---|---|---|---|---|
| 2015/0289067 | A1 | 10/2015 | Riepenhoff | |
| 2017/0215013 | A1* | 7/2017 | Tan | H04R 25/609 |
| 2017/0280256 | A1 | 9/2017 | Pedersen et al. | |

FOREIGN PATENT DOCUMENTS

| | | |
|---|---|---|
| EP | 3 110 170 A1 | 12/2016 |

* cited by examiner

*Primary Examiner* — Harry S Hong
(74) *Attorney, Agent, or Firm* — Birch, Stewart, Kolasch & Birch, LLP

(57) ABSTRACT

A device is provided. The device includes an antenna for communicating with one or more hearing aids. The device further comprises a coil for receiving a wireless signal. The device comprises a first ground plane connected to the antenna. The device comprises a second ground plane connected to the coil. The first ground plane and the second ground plane are decoupled via a decoupling element so that noise from one ground plane does not propagate to the other ground plane at certain frequencies.

20 Claims, 2 Drawing Sheets

DEVICE WITH DECOUPLING ELEMENT CONFIGURED BETWEEN RESPECTIVE GROUND PLANES FOR ANTENNA AND COIL

FIELD

The present disclosure relates to a device with a coil. More particularly, the disclosure relates to a device having a telecoil for receiving a wireless signal and an antenna for transmitting a signal based on the wireless signal received by the telecoil. Moreover, the present disclosure relates to a device having a coil for receiving a wireless signal, and further being configured to be in wireless communication with one or more hearing aids. The device may be a microphone device, such as an auxiliary device comprising one or more microphone units or microphone system, configured to wirelessly communicate with a hearing aid and/or hearing aid system.

BACKGROUND

For various reasons people with hearing aids are provided with an external, wearable or portable, device with one or more microphones, and sometimes with a telecoil. The telecoil may be configured to receive a baseband modulated signal from a system, often built into a structure such a room/floor, in homes, workplaces, entertainment venues, places of worship, courtrooms, ticket counters, information booths at a wide variety of museums and other venues, physician offices, pharmacy counters, elevators, trains, taxis in New York City, buses, transportation, food and dining, and education rooms, and similar areas where it could be beneficial to provide a wireless representation of a microphone signal to a hearing aid user. Such an external device could be provided with an antenna configured to operate e.g. in the GHz region and provide a signal to one or more hearing aids. However, as the telecoil often comprises a rather large coil, and electronic components in the external device draw power and operate at various levels and frequency regions, there is a risk of generating electromagnetic noise that interfere with the telecoil and thus lower the sensitivity.

Therefore, there is a need to provide a solution that addresses at least some of the above-mentioned problems, and the present disclosure provides at least an alternative to the prior art.

SUMMARY

According to an aspect, the present disclosure relates to a device comprising a device housing, and the device includes a first antenna configured to emit and/or receive electromagnetic energy, the first antenna having a first operational frequency. This could be an antenna for communicating with a relatively short distance, such as below 100 meters. This type of antenna includes an antenna suitable for supporting a protocol such as Bluetooth, Bluetooth Low Energy, or the like. The device may further comprise a wireless interface arranged to communication with one or more external devices via the first antenna. Such a wireless interface could be configured to support data exchange using a protocol such as Bluetooth or the like, being either an open standard or a proprietary standard. The device may further comprise a coil configured to receive a signal at a second operational frequency, the second operational frequency being lower than the first operational frequency. The second operational frequency may be in a frequency range, and for a case where the coil is a telecoil, the second operational frequency is defined by the band around the baseband modulated signal picked up by the telecoil. Preferably, the frequency range comprises a second operational frequency. More preferably, the frequency range, here also termed the second frequency range, does not overlap with the first frequency. As an alternative definition, the second operational frequency could be a frequency threshold or limit. Generally, such a coil could be configured to receive, or even also transmit, signals using inductive communication. Examples of such coils include the so-called telecoils. Other examples include other types of inductive communication coils specifically configured for short distance, bi-directional, communication. The device may further comprise a first element configured as a ground plane for the first antenna and a second element configured as a ground plane for the coil. Having separate elements configured as respective ground planes for the first antenna and the coil allow for reducing noise induced from one of the components, e.g. the first antenna, to the other component, e.g. to the coil. The first antenna may thus be a radiating antenna configured to emit and/or receive high frequency signals. The device may further comprise a decoupling element arranged between the first element and the second element, the decoupling element may be configured to attenuate frequencies at a third frequency. This is advantageous in that disturbing signals originating at one of the antennae is not transferred via the ground plane to the other antenna, this is especially useful at the coil as operational noise from a high-frequency antenna may propagate via a shared or connected ground plane to the coil, thereby reducing the sensitivity of the coil. The components recited here are preferably all arranged in the device housing. The device according to the present disclosure may act as a gateway device, or auxiliary device, being part of a communication between other devices and one or more hearing aids. This means that the device housing is configured to be worn by a user, at a location which is not at the head but could be clipped on to the clothes of the user, held in the hand of the user, or even placed on e.g. a table or the like. This is contemplated to allow the device to, at least, receive a wireless signal via the coil and retransmit a signal based thereon via the first antenna. Additional, or alternative, sound may be picked up via a microphone system in the device, as elsewhere in the present disclosure.

In one instance, the device may be configured so as to not comprise a wireless interface configured to communicate with a mobile phone network, such as a GSM based network or the like.

The present disclosure provides, among other things, a device comprising a device housing. The device housing may include input elements, such as push buttons, plugs, microphones etc. The device housing may include a fastening member configured to releasably attach the housing to clothing of a user, and, may be formed so as to allow the housing to be positioned on a flat surface such as a table or the like. Other attachment elements may be provided, such as neck-string allowing the housing to be carried around the neck of a user without the housing being attached to any clothing. The device may comprise a first antenna configured to emit and/or receive electromagnetic energy, the first antenna having a first operational frequency. The first antenna may provide a channel for communicating to and/or from the device to external devices such as a number of hearing aids. The device may comprise a wireless interface arranged to communication with one or more external devices via the first antenna. The wireless interface may be configured based on a protocol. Such a protocol may be or include a standardized protocol, such as Bluetooth and/or Bluetooth Lowe Energy, or a proprietary protocol, or even multiple protocols handled by the same wireless interface. Alternatively, the wireless interface may comprise sub-wireless interfaces each configured to handle a specific protocol. The device may comprise a first element configured as a ground plane for the first antenna. The first element may be formed in, on or at a substrate configured to carry one or more electronic components of the device. The device may comprise one or more substrates each configured to carrying one or more components and/or conductive layers. The device may comprise a coil configured to receive a signal at a second operational frequency, the second operational frequency being lower than the first operational frequency. The coil may be configured to receive, and/or transmit, signals inductively. When receiving, a current is induced in the coil, which may be an air coil or have a core. The current is then translated into a signal representing sound. Most often, i.e. when the coil is configured as a so-called telecoil, the signal received at the coil is baseband modulated and the amplitude corresponds to variates in the sound signal. Other types of signals may be used. The device may comprise a second element configured as a ground plane for the coil. As will be evident from the present description, the second element may be part of, enclosed by or encompassed, with the first element, or at least an area defined by the first and second elements respectively. The device may comprise a decoupling element is arranged between the first element and the second element, the decoupling element configured to attenuate frequencies at a third frequency. This decoupling element is configured so that signals in one of the ground planes do not readily propagate into other ground plane or planes. The decoupling element may be configured as a low pass filter, or a band stop filter, or a high pass filter.

It has been seen that when a wireless interface for a high frequency antenna draw power from a battery of the device, and as the antenna is connected to a ground plane in the device, the current loop created as current run from the battery to the wireless interface and back to ground induce noise in the device. Noise may be in the form of an H-field created by a current loop between battery and wireless interface, but even more so by noisy currents in the ground plane. By decoupling the ground plane at or around the coil this noise is avoided or at least reduced.

The first element may have a first outer geometry delimiting a first area, and the second element may have a second outer geometry having a second area. The ratio of the size of these two areas may be in the range of 1:4 to 1:100, such as 1:10 to 1:20. The first element may for instance be defined, more or less, by inner geometry of the housing, e.g. by the outer contour of a substrate arranged inside the housing. The outer geometry may include one or more indents, i.e. if the general outline of the element would be rectangular, an area may be excluded from the element, e.g. as a cut-out area, such as part of a corner of a rectangle. The exclusion may be purely mechanical in that the excluded area may be connected electrically but not necessarily mechanically. A plurality of decoupling elements may be provided at one or more respective positions along a periphery of the first element and/or the second element.

The second element may be positioned inside or as part of the first area, and/or next to the first area. The decoupling element may then be configured so as to decouple signals below the third frequency, where the third frequency is higher than the second operational frequency. This could, as mentioned, be in the form of a low pass filter or bandpass filter, or band stop filter.

The third frequency may be a frequency range at least partly overlapping the second frequency range. This could for instance be the case where the third frequency is higher than the second frequency and the decoupling element acts as a low pass filter. The second frequency may be a threshold frequency, below which a received, or transmitted, baseband modulated signal is mainly found, e.g. which could be the case when the coil is a telecoil.

The second element may further be configured to as ground for a wireless interface connected to the coil. As the coil could include or be connected to, a wireless interface separate from the wireless interface for the first antenna, there is a need for a wireless interface for the coil. Coupling this wireless interface to the same ground plane, or at least a ground plane separate from the ground plane for the first antenna, noise from the operation of the first antenna is reduced as the coil and/or wireless interface for the coil.

The first antenna may include, or be composed of, a first planar element arranged at a distance from the first element. This could for instance be, part of, a substrate where a conductive plane is formed on or in the substrate. Such a substrate may then be arranged in the housing at a distance from a substrate defining or carrying the ground plane for the first antenna.

With a first planar element constituting or being part of the first antenna, the first planer element may be arranged parallel, and parallel shifted, relative to the first element. This allow an at least somewhat well defined arrangement of the antenna relative to the ground plane.

The first antenna may be positioned centered relative to the first element. This is contemplated to help shape the radiation pattern from the antenna to a more omnidirectional characteristic pattern. This is an especially advantageous radiation pattern for the antenna when the device is operated in a broadcasting mode where signals are to be transmitted from the device to a number of hearing aids in the vicinity. Each of the receiving hearing aids may be individual hearing aids or binaural hearing aids.

The device may define a rectangular or square area, and the second element may be positioned at a corner of the rectangular or square. This is contemplated to help lower noise induced in the coil further. The rectangular or square area could be seen as defined at a plane defined through the device, e.g. at a midpoint of the housing or at/near the top or bottom.

A third element may be configured to as ground for a wireless interface connected to the coil, and wherein a second decoupling element is arranged between the third element and the first element. Having multiple ground plane for the various active elements in the device may help isolate noise even further.

The decoupling element may be configured to attenuate frequencies around or below 5 KHz, such as 1 KHz, such as a high pass filter passing only signals above 5 KHz, or above 1 KHz. This could allow a higher frequency antenna to utilize the combined ground plane, e.g. the first and the second ground plane combined, as ground plane for the first antenna, while isolating the coil on it's own. This may be advantageous for shaping the radiating pattern from the first antenna. The combined ground plane is thus contemplated to be larger than the first ground plane and further allow the first antenna to be positioned centered relative to the (combined) ground plane.

The first antenna may be configured to operate in the frequency range of 2 to 6 GHz, such as around 2.4 GHz, such as around 5 GHz.

The coil may be a telecoil. Having a telecoil as a receiving coil allow the device to act as an interface between a telecoil transmitter and one or more hearing aids, which e.g. is not equipped with telecoils or for other reasons receive audio signals from the device. Other types of coils for nearfield communication may be employed. Generally, coils are suitable for registering magnetic field fluctuations and converting them into a signal to be processed, either directly or via a conversion and/or decoding.

The first element and the second element may be formed as separate elements on the same substrate or as separate elements on different substrates. Forming the two elements on separate parts allow a physical separation of the two ground planes.

Advantageously, the third frequency may be a frequency range at least partly overlapping the second frequency range. This could allow for attenuation of noise entering the coil in a frequency range around the operational frequency range of the coil.

Advantageously, the second element may further be configured to as ground for a wireless interface connected to the coil. Providing a separate ground for the coil will reduce noise contribution to the coil from e.g. internal components of the device and/or ingress electromagnetic noise picked up by the ground connected to the other antenna.

Advantageously, a third element may be configured to as ground for a wireless interface connected to the coil, and wherein a second decoupling element is arranged between the third element and the first element. The wireless interface connected to the coil may be part of the wireless interface for the first antenna or may be a separate wireless interface specifically for the coil and/or may be embodied as two parts of the same physical device or as two completely separate physical devices. The signal received via the coil may be baseband modulated.

Advantageously, the decoupling element may be configured to attenuate frequencies around 1 KHz. The decoupling element may be configured to attenuate, or dampen, in or around a frequency range.

The first antenna may be configured to operate in the frequency range of 2 to 6 GHz, such as around 2.4 GHz, such as around 5 GHz. Operating in these frequency ranges may be advantageous as they are most often used for short range communication using protocols such as Bluetooth and Bluetooth Low Energy, etc.

In the device as described herein, the coil may be a telecoil. This allow the device to be used as a separate device providing telecoil functionality to hearing device without a built-in telecoil, or to provide telecoil functionality to a hearing aid when a built-in telecoil is not optimal to be used, e.g. due to an environment with much electromagnetic noise, either internally to the hearing aid or in the surrounding environment.

The first element and the second element may be formed as separate elements on the same substrate or as separate elements on different substrates. Forming the two grounds as separate element could be useful in lowing the coupling of noise between the two grounds planes, but in situations where other considerations force the two to be formed on/in the same substrate, this is still possible in the context of the present description.

A zone may be formed substantially around the wireless interface, wherein the zone decouples signals outside the first frequency originating from the wireless interface. The zone may be in the form of a physical separation, such as a gap between e.g. a ground and the area below the wireless interface. The zone may be formed as a gap in conductive material in a substrate. This allow a ground to be formed with no or low coupling to the area within the zone in e.g. the same plane of the substrate in which it is formed. The gap may e.g. include a nonconductive area as a physical/mechanical connection between two parts so as to ensure mechanical stability, and the gap may then be seen as a gap in the electrical sense.

One or more additional decoupling elements may be provided in one or more electrical connections going through the zone. Through the zone in the present context means between an element, or several elements, in the zone and one or more elements outside the zone.

The zone may define an area larger than the area of defined by the wireless interface, such as 10% larger, such as 25% larger, such as twice the area. This allow a zone to be established around the wireless interface. It has been found that noise may arise from a wireless interface, which may originate from current draws and/or the operational frequency of the wireless interface.

The decoupling element may be or comprise, one or more of: a band-pass filter, a band-stop filter, a notch filter, a low-pass filter, a high-pass filter, or a combination thereof. If a low-pass or high pass filter construction is chosen, it may be simple and/or robust and/or price efficient to implement and still allow efficient communication The zone may be decoupled at frequencies below 100 MHz, such as below 10 MHz, such as below 1 MHz. This could be useful to prevent, or at least lower, the noise from a component and being located in the zone to propagate to components located outside the zone and being sensitive in this frequency region.

One or more capacitors may be used for decouple one or more grounds. The use of capacitors could be advantageous as they allow for an easy implementation of a filter structure between a ground and other components.

The first antenna may be a radio frequency antenna. The first antenna may include or be formed as an IFA antenna, a slot antenna, a loop antenna, a dipole antenna or other suitably shaped antenna structure.

A zone may be formed substantially around the wireless interface, for the first antenna, wherein the zone decouples signals outside the first frequency originating from the wireless interface. The zone may be formed as a gap in conductive material in a substrate. One or more additional decoupling elements may be provided in one or more electrical connections going through the zone.

The zone may define an area larger than the area of defined by the wireless interface, such as 10% larger, such as 25% larger, such as twice the area.

Generally, the decoupling element may be or may comprise one or more of: a band-pass filter, a band-stop filter, a notch filter, a low-pass filter, a high-pass filter, or a combination thereof.

The zone, and/or all or any of the decoupling elements, may decouple frequencies below 100 MHz, such as below 10 MHz, such as below 1 MHz. The decoupled frequencies may advantageously be or include the operational frequency of the coil.

One or more capacitors may be configured to decouple one or more grounds. Ground planes may be arranged in series, e.g. cascading, and decoupling elements between one ground plane and the following ground plane may be configured for one frequency range and may be different from a decoupling element between the ground plane and the previous ground plane.

The features mentioned herein may be combined to create a flexible device providing high preforming first antenna and a coil with low noise properties.

BRIEF DESCRIPTION OF DRAWINGS

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effect will be apparent from and elucidated with reference to the illustrations described hereinafter in which:

DETAILED DESCRIPTION

Figure 1:
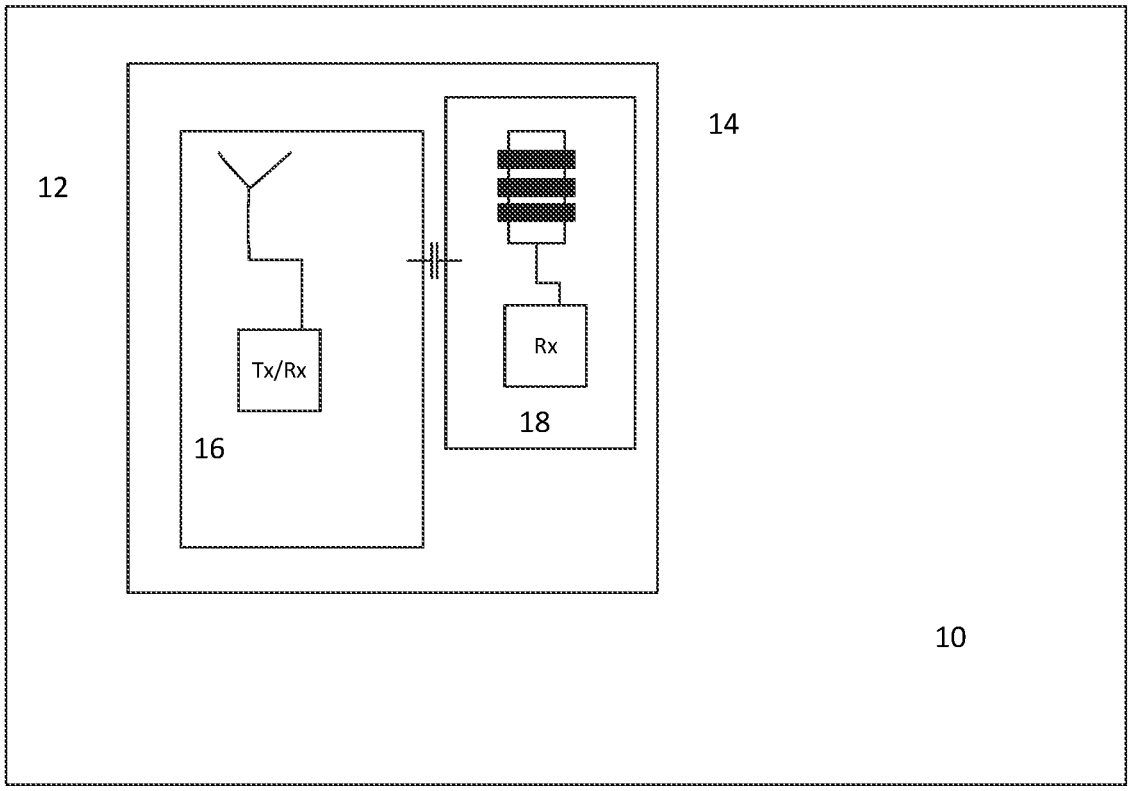
FIG. 1 schematically illustrate an antenna and a coil connected to separate ground planes, FIG. 2 schematically illustrate a coil connected to a wireless interface and corresponding ground planes, FIG. 3 schematically illustrates a ground plane with a cut-out area, FIG. 4 schematically illustrates a ground plane with a cut-out area and an additional ground plane.

The detailed description set forth below in connection with the appended drawings is intended as a description of various configurations. The detailed description includes specific details for the purpose of providing a thorough understanding of various concepts. However, it will be apparent to those skilled in the art that these concepts may be practiced without these specific details. Several aspects of the apparatus and methods are described by various blocks, functional units, modules, components, circuits, steps, processes, algorithms, etc. (collectively referred to as "elements"). Depending upon particular application, design constraints or other reasons, these elements may be implemented using electronic hardware, computer program, or any combination thereof.

The electronic hardware may include microprocessors, microcontrollers, digital signal processors (DSPs), field programmable gate arrays (FPGAs), programmable logic devices (PLDs), gated logic, discrete hardware circuits, and other suitable hardware configured to perform the various functionality described throughout this disclosure. Computer program shall be construed broadly to mean instructions, instruction sets, code, code segments, program code, programs, subprograms, software modules, applications, software applications, software packages, routines, subroutines, objects, executables, threads of execution, procedures, functions, etc., whether referred to as software, firmware, middleware, microcode, hardware description language, or otherwise.

A hearing aid may be adapted to improve or augment the hearing capability of a user by receiving an acoustic signal from a user's surroundings, generating a corresponding audio signal, possibly modifying the audio signal and providing the possibly modified audio signal as an audible signal to at least one of the user's ears. The "hearing aid" may further refer to a device such as an earphone or a headset adapted to receive an audio signal electronically, possibly modifying the audio signal and providing the possibly modified audio signals as an audible signal to at least one of the user's ears. Such audible signals may be provided in the form of an acoustic signal radiated into the user's outer ear, or an acoustic signal transferred as mechanical vibrations to the user's inner ears through bone structure of the user's head and/or through parts of middle ear of the user or electric signals transferred directly or indirectly to cochlear nerve and/or to auditory cortex of the user.

The hearing aid is adapted to be worn in any known way. This may include i) arranging a unit of the hearing aid behind the ear with a tube leading air-borne acoustic signals into the ear canal or with a receiver/loudspeaker arranged close to or in the ear canal such as in a Behind-the-Ear type hearing aid, and/or ii) arranging the hearing aid entirely or partly in the pinna and/or in the ear canal of the user such as in a In-the-Ear type hearing aid or In-the-Canal/Completely-in-Canal type hearing aid, or iii) arranging a unit of the hearing aid attached to a fixture implanted into the skull bone such as in Bone Anchored Hearing Aid or Cochlear Implant, or iv) arranging a unit of the hearing aid as an entirely or partly implanted unit such as in Bone Anchored Hearing Aid or Cochlear Implant.

A "hearing system" refers to a system comprising one or two hearing aids, and a "binaural hearing system" refers to a system comprising two hearing aids where the devices are adapted to cooperatively provide audible signals to both of the user's ears. The hearing system or binaural hearing system may further include auxiliary device(s) that communicates with at least one hearing aid, the auxiliary device affecting the operation of the hearing aids and/or benefitting from the functioning of the hearing aids. A wired or wireless communication link between the at least one hearing aid and the auxiliary device is established that allows for exchanging information (e.g. control and status signals, possibly audio signals) between the at least one hearing aid and the auxiliary device. Such auxiliary devices may include at least one of remote controls, remote microphones, audio gateway devices, mobile phones, public-address systems, car audio systems or music players or a combination thereof. The audio gateway is adapted to receive a multitude of audio signals such as from an entertainment device like a TV or a music player, a telephone apparatus like a mobile telephone or a computer, a PC. The audio gateway is further adapted to select and/or combine an appropriate one of the received audio signals (or combination of signals) for transmission to the at least one hearing aid. The remote control is adapted to control functionality and operation of the at least one hearing aids. The function of the remote control may be implemented in a SmartPhone or other electronic device, the SmartPhone/electronic device possibly running an application that controls functionality of the at least one hearing aid.

In general, a hearing aid includes i) an input unit such as a microphone for receiving an acoustic signal from a user's surroundings and providing a corresponding input audio signal, and/or ii) a receiving unit for electronically receiving an input audio signal. The hearing aid further includes a signal processing unit for processing the input audio signal and an output unit for providing an audible signal to the user in dependence on the processed audio signal.

The input unit may include multiple input microphones, e.g. for providing direction-dependent audio signal processing. Such directional microphone system is adapted to enhance a target acoustic source among a multitude of acoustic sources in the user's environment. In one aspect, the directional system is adapted to detect (such as adaptively detect) from which direction a particular part of the microphone signal originates. This may be achieved by using conventionally known methods. The signal processing unit may include amplifier that is adapted to apply a frequency dependent gain to the input audio signal. The signal processing unit may further be adapted to provide other relevant functionality such as compression, noise reduction, etc. The output unit may include an output transducer such as a loudspeaker/receiver for providing an air-borne acoustic signal transcutaneously or percutaneously to the skull bone or a vibrator for providing a structure-borne or liquid-borne acoustic signal. In some hearing aids, the output unit may include one or more output electrodes for providing the electric signals such as in a Cochlear Implant.

FIG. 1 schematically illustrate parts of a device 10 according to the present disclosure, where two separate ground planes 12, 14 are provided.

A first ground plane 12 is connected to an RF antenna 16, i.e. a first antenna, and corresponding wireless interface. The wireless interface is here configured to transmit and receive (Tx/Rx). The wireless interface is configured to communicate to/from external device using the RF antenna 16. The wireless interface is configured to communicate using a data protocol, here Bluetooth is chosen, in particular Bluetooth Low Energy. Other suitable data protocols may be selected. The wireless interface may establish wireless communication between the device and one or more hearing aids. The wireless interface may be configured to broadcast audio to a number of hearing aids located within e.g. a class room or other such area were a number of people wearing hearing aids would benefit from receiving audio wirelessly. Presently antennas for supporting Bluetooth-based protocols are configured to transmit and/or receive at an operational frequency around 2.4 GHz, but other suitable frequencies may be use, e.g. carrier frequency around 5 GHz is also envisioned. The antenna 16 may e.g. be configured to operate at a frequency in the so-called ISM band.

Figure 4:
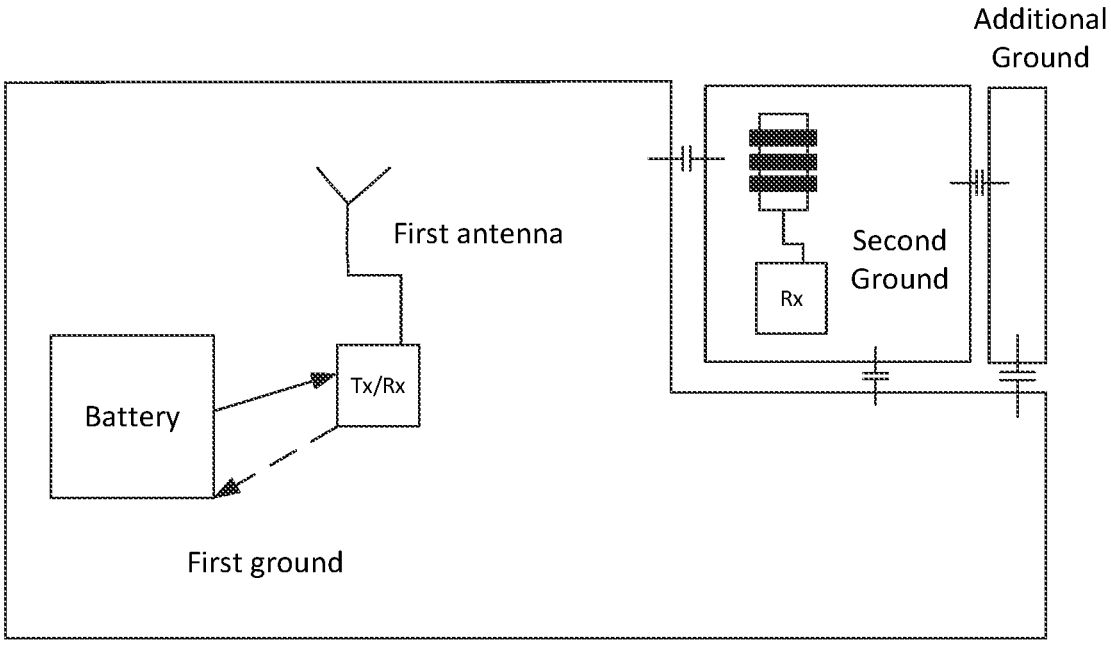

When the wireless interface draw power from the battery a current is obviously running from the battery to the wireless interface, but, additionally, as the wireless interface is connected to a ground plane, a further current flow to the ground. This create a current loop which create an H-field which may disturb the coil. This is illustrated in FIG. 4 by the arrow from the battery to the wireless interface and the punctured line from the wireless interface towards the battery. Additionally, current flow in the ground plane itself at frequencies that may disturb the coil. By decoupling the part of the ground connected to the coil, this noise may be eliminated or at least reduced.

A second ground plane 14 is arranged in connection with a coil 18. The coil is primarily for receiving wireless signals. The coil 18 is here a so-called Telecoil and arranged for receiving baseband modulated signal from a telecoil signal transmitter.

When the RF antenna/wireless interface 16 operates, it requires a substantial amount of power draw from the internal power source, i.e. here a battery located in the housing of the device. This is especially seen when the wireless interface transmits, such as in broadcast mode.

The wireless interface will operate to transmit different kind of data based on the data protocol, e.g. including beacon/advertising data and other kinds of regularly transmitted, or received, data. Each operation creates a current draw from the battery. As the operations may be periodic this may introduce noise at a frequency corresponding to this periodic operation.

The coil has a given sensitivity and it has been seen that EM noise originating from the wireless interface of the RF system may interfere with the coil. As a countermeasure for this noise, a decoupling element is arranged between the ground plane so as to decouple them from each other. In particular, the decoupling between the two ground planes may be configured so as to decouple frequencies around, or below, 1 KHz.

The decoupling element creates at least two area that are decoupled at low frequency <1 MHz. At high frequency, e.g. at 2.4 GHz and above, excellent connection is provided with equidistant placed decoupling elements.

The two grounds may be seen as a main ground plane and a floating ground plane, where the floating ground plane is smaller in area than the larger, main, ground plane. The floating ground plane may be connected to e.g. the coil.

A number of decoupling elements may be positioned between the two ground planes, e.g. a number of equidistantly placed decoupling elements. Preferably, all decoupling elements are of identical type and electrical properties. It has been advantageous to use capacitors with a capacitance around 10 pF. Generally, the decoupling element may be or include a capacitor, or a number of capacitors and/or ESD diodes.

Figure 2:
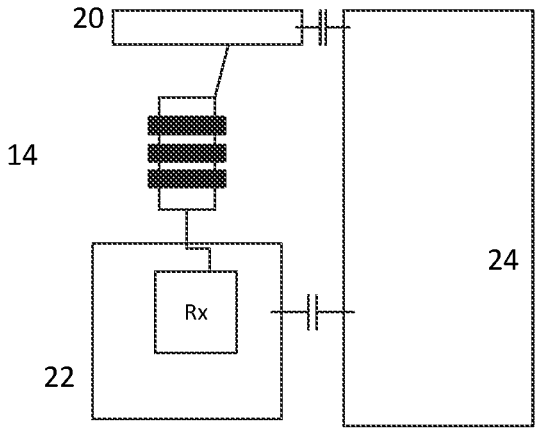

FIG. 2 is a schematic view where a coil 14 is (electrically) connected to a, smaller, ground plane 20 and the corresponding wireless interface is connected to a different ground plane 22. A decoupling element is provided between the smaller ground plane 20 of the coil and a larger, main, ground plane 24 located nearby.

As such, a device according to the present disclosure may comprise a number of ground planes, where a main ground plane is connected via one or a number of decoupling elements to one or more smaller/additional ground plane or planes. The decoupling element ensures that noise at least at a frequency, is not propagated through the ground plane to sensitive elements in the device.

As described herein the device is a device configured to communication with one or more hearing aids. This device may form part of a hearing aid system, sometimes known as an auxiliary device. A hearing aid system may comprise two hearing aids to be worn by a user and the device, i.e. the auxiliary device. The device may include a number of plugs for connecting the device to one or a number of wired sound sources, and may be in the form for a mini-jack plug, a USB plug, a HDMI input or the like. Further, a second antenna or at least a second wireless interface may be included to receive sound from a second wireless source. Such an additional source may be received as a separate channel by the same wireless interface as mentioned herein.

The device may comprise one or more microphones for sensing and converting ambient audio to a signal that may be transmitted via the RF antenna to connected or receiving hearing aids. The ambient sound may be mixed with wirelessly received sound, and the mix may be transmitted to the hearing aid or hearing aids. In a broadcasting mode the hearing aid do not need to perform bonding and pairing etc, and thus need not be connected per se. This could depend on the protocol used for communicating between the device and the one or more hearing aids.

The coil may be positioned at one end of the device, and the RF antenna may advantageously be formed as remote from the coil as possible, e.g. at the other end, or at least the RF antenna may be designed so that the electrical field generated by the antenna has a maximum as far away from the coil as possible, or at least being from so as to minimize the magnetic field induced as the coil as much as possible.

As the device may have an overall rectangular shape, the coil may be arranged to have a main pickup direction orientated parallel to the short side of the rectangular shape.

Figure 3:
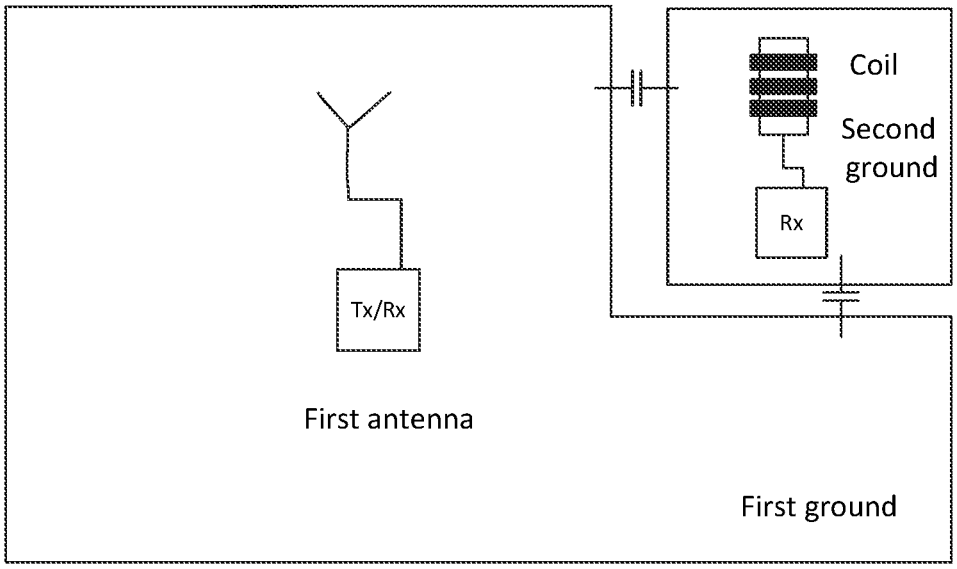

FIG. 3 schematically illustrates a first ground, being the larger ground, with a cut-out, i.e. the square/rectangular shaped area to the top-right hand corner. The smaller, second ground plane is connected to the coil. Here is illustrated two decoupling elements between the second ground and the first ground, but more may be added. The first antenna, i.e. the RF antenna, is located symmetrical with respect to the outer geometry defined by the first ground plane. As the decoupling elements decouple lower frequencies and allow higher frequencies to pass, the ground plane for the first antenna may be seen as the combined first and second ground planes. For the coil, the ground plane will be the second ground. As mentioned, noise travelling in the first ground will not be able to reach the coil due to the decoupling at the noise/operation frequency of the coil. Noise may travel in the first ground plane along the cut-out area but will not, or at least to only a small degree, affect the coil located at the second ground plane. Eventually, noise will be dissipated in the ground plane(s)

FIG. 4 schematically illustrate, similar to FIG. 3, that a first ground plane has a cut-out area where a second, floating, ground is formed and connected to the coil. In addition, a further ground is connected and located further to the right of the second ground. Decoupling elements are provided between the second ground and the further ground. The further ground plane may be directly connected to the first ground.

Generally, the signal from the coil could be transferred to a signal processor located at the first ground. This signal path could also include decoupling elements to isolate the coil. The signal from the coil may be converted to a digital signal before leaving the second ground or be transferred to a processor located at the first ground plane.

It is intended that the structural features of the devices described above, either in the detailed description and/or in the claims, may be combined with steps of the method, when appropriately substituted by a corresponding process.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element but an intervening elements may also be present, unless expressly stated otherwise. Furthermore, "connected" or "coupled" as used herein may include wirelessly connected or coupled. As used herein, the term "and/or" includes any and all combinations of one or more of the associated listed items. The steps of any disclosed method is not limited to the exact order stated herein, unless expressly stated otherwise.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more.

The present disclosure also relates to the following items:

1. A device comprising a device housing,
   - a first antenna configured to emit and/or receive electromagnetic energy, the first antenna having a first operational frequency,
   - a wireless interface arranged to communication with one or more external devices via the first antenna,
   - a first element configured as a ground plane for the first antenna,
   - a coil configured to receive a signal at a second operational frequency, the second operational frequency being lower than the first operational frequency,
   - a second element configured as a ground plane for the coil, wherein a decoupling element is arranged between the first element and the second element, the decoupling element configured to attenuate frequencies at a third frequency.

2. The device according to item 1, wherein the first element has a first outer geometry delimiting a first area, and the second element has a second outer geometry having a second area.

3. The device according to item 2, wherein the second element is positioned inside or is part of the first area, wherein the decoupling element decouples signal below the third frequency being higher than the second operational frequency.

4. The device according to any one of items 1-3, wherein the third frequency is a frequency range at least partly overlapping the second frequency range.

5. The device according to any one of items 1-4, wherein the second element is further configured to as ground for a wireless interface connected to the coil.

6. The device according to any one of items 1-5, wherein the first antenna includes a first planar element arranged at a distance from the first element.

7. The device according to any one of items 1-6, wherein the first planer element is parallel shifted relative to the first element.

8. The device according to any one of items 1-7, wherein the first antenna is positioned centered relative to the first element.

9. The device according to any one of items 1-8, wherein the device defines a rectangular or square area, and the second element is positioned at a corner of the rectangular or square are.

10. The device according to any one of items 1-9, wherein a third element is configured to as ground for a wireless interface connected to the coil, and wherein a second decoupling element is arranged between the third element and the first element.

11. The device according to any one of item 1-10, wherein the decoupling element is configured to attenuate frequencies around or below 5 KHz.

12. The device according to any one of item 1-11, wherein the first antenna is configured to operate in the frequency range of 2 to 6 GHz, such as around 2.4 GHz, such as around 5 GHz.

13. The device according to any one of item 1-12, wherein the coil is a telecoil.

14. The device according to any one of item 1-13, wherein the first element and the second element are formed as separate elements on the same substrate or as separate elements on different substrates.

15. The device according to any one of item 1-14, wherein a zone is formed substantially around the wireless interface wherein the zone decouples signals outside the first frequency originating from the wireless interface.

Accordingly, the scope should be judged in terms of the claims that follow.

The invention claimed is:

1. A gateway device comprising a device housing, the device housing comprising:

a first antenna configured to emit and/or receive electromagnetic energy, the first antenna having a first operational frequency being in a range of 2 to 6 GHz, a wireless interface configured to communication with one or more external hearing aid devices via the first antenna, a first element configured as a ground plane for the first antenna, a telecoil configured to receive a baseband modulated signal at a frequency range that is lower than the first operational frequency, a second element configured as a ground plane for the telecoil, wherein a decoupling element is configured between the first element and the second element, the decoupling element comprising an electrical component configured as, or part of, a filter configured to attenuate frequencies below a third frequency to a greater extent than frequencies above the third frequency, the third frequency being between the first frequency and the frequency range of the telecoil.

2. The device according to claim 1, wherein the first element has a first outer geometry delimiting a first area, and the second element has a second outer geometry having a second area.

3. The device according to claim 2, wherein the second element is positioned inside or is part of the first area, wherein the decoupling element decouples signal below the third frequency, where the third frequency is higher than an upper boundary of the frequency range of the telecoil.

4. The device according to claim 1, wherein the third frequency is a frequency range at least partly overlapping the frequency range of the telecoil.

5. The device according to claim 1, wherein the second element is further configured as ground for a second wireless interface connected to the telecoil.

6. The device according to claim 1, wherein the first antenna includes a first planar element arranged at a distance from the first element.

7. The device according to claim 6, wherein the first planar element is parallel shifted relative to the first element.

8. The device according to claim 1, wherein the first antenna is positioned centered relative to the first element.

9. The device according to claim 1, wherein the device defines a rectangular or square area, and the second element is positioned at or in a corner of the rectangular or square area.

10. The device according to claim 1, wherein a third element is configured as a ground plane for a second wireless interface, which is connected to the telecoil, and wherein a second decoupling element is arranged between the third element and the first element, the second decoupling element comprising a second electrical component configured as, or part of, a filter to attenuate signals of a particular frequency or frequency range between the first element and the third element.

11. The device according to claim 1, wherein the decoupling element is configured to attenuate frequencies around or below 5 kHz.

12. The device according to claim 1, wherein the first antenna is configured to operate in the frequency range of 2 to 6 GHz.

13. The device according to claim 1, wherein the first element and the second element are formed as separate elements on a same substrate or as separate elements on different substrates.

14. The device according to claim 1, wherein a zone is formed substantially around the wireless interface wherein the zone decouples signals outside the first frequency originating from the wireless interface.

15. A device comprising a device housing, the device housing comprising:

a first antenna configured to emit and/or receive electromagnetic energy, the first antenna having a first operational frequency, a wireless interface configured to communication with one or more external hearing aid devices via the first antenna, a first element configured as a ground plane for the first antenna, a coil configured to receive a signal in a second operational frequency range, the second operational frequency range being lower than the first operational frequency, a second element configured as a ground plane for the coil, wherein a decoupling element is arranged between the first element and the second element, the decoupling element comprising an electrical component configured as, or part of, a filter configured to attenuate frequencies at a third frequency range to a greater extent than frequencies outside the third frequency range, wherein at least one of the first operational frequency and the second operation frequency range is excluded from the third frequency range.

16. The device according to claim 15, wherein the coil is a telecoil.

17. The device according to claim 1, wherein the decoupling element is configured as one or more of: a band-pass filter, a band-stop filter, a notch filter, a high-pass filter, and a low-pass filter.

18. The device according to claim 17, wherein the electrical component is a capacitor or an electro static discharge (ESD) diode.

19. The device according to claim 15, wherein the decoupling element is configured as one or more of: a band-pass filter, a band-stop filter, a notch filter, a high-pass filter, and a low-pass filter.

20. The device according to claim 19, wherein the electrical component is a capacitor or an electro static discharge (ESD) diode.

* * * * *